United States Patent [19]

Williams et al.

[11] Patent Number: 4,585,218

[45] Date of Patent: Apr. 29, 1986

[54] MECHANISM FOR FEEDING SIMILAR FLAT ITEMS IN SUCCESSION FROM A STACK THEREOF

[75] Inventors: Thomas D. Williams, Billericay; Paul Usher, Harpender, both of England

[73] Assignee: Roneo Alcatel Limited, Romfort, England

[21] Appl. No.: 716,160

[22] Filed: Mar. 26, 1985

[30] Foreign Application Priority Data

Apr. 26, 1984 [GB] United Kingdom ..... 8410714

[51] Int. Cl.[4] ..... B65H 5/00

[52] U.S. Cl. ..... 271/10; 101/232; 221/242; 271/111; 271/118; 271/144; 414/129

[58] Field of Search ..... 271/10, 114–118, 271/2, 144, 267, 171, 110, 111; 101/232; 414/129, 130; 221/237, 242

[56] References Cited

U.S. PATENT DOCUMENTS 2,880,996 4/1959 Stiles ..... 271/114

4,158,456 6/1979 Holland-Letz ..... 271/118

4,284,269 8/1981 Ignatjev ..... 271/171

*Primary Examiner*—Bruce H. Stoner, Jr.

*Assistant Examiner*—John A. Carroll

*Attorney, Agent, or Firm*—Shoemaker and Mattare, Ltd.

[57] ABSTRACT

Improvements result from using a feed roller always rotating at a constant surface speed to feed mail items successively with gaps between them from a stack to a franking machine without undue variations in the gap lengths when there are variations in the mail item lengths in respective stacks. A cam rocks a cradle about an input roller axis to bring a feed roller against the stack at a frequency to feed the items forward one by one. Gearing between rollers drives a two speed transmission to a cam via one way clutches. For envelopes shorter than a predetermined limit, the higher speed drive operates. When a rear mail guide member engages envelopes longer than the limit, a lever allows a pawl to disengage a wrap spring clutch disabling the higher speed drive and rendering the lower speed drive effective.

10 Claims, 2 Drawing Figures

MECHANISM FOR FEEDING SIMILAR FLAT ITEMS IN SUCCESSION FROM A STACK THEREOF

FIELD OF THE INVENTION

This invention relates to mechanisms for feeding similar flat items in succession from a stack thereof. The invention is primarily concerned with feeding items of mail into postal franking machines but similar problems will occur to those skilled in the art to which the present invention could usefully be applied.

When automatically feeding items of mail into a postal franking machine, it is necessary to feed at a rate which will supply a continuous stream of items with a gap between each one. The minimum gap required between items is a function of the postal franking machine employed.

Since there is a wide variation in lengths of mail, with a fixed speed system, it is necessary to select a feed rate that will provide the minimum required gap with the longest items.

If a method of changing the feed rate is available, mail of up to some intermediate length could be fed at a faster rate, still providing the required minimum gap between items, significantly improving the efficiency of mail throughput. It is an obvious advantage if this intermediate length is selected to include the most commonly used envelope lengths.

DESCRIPTION OF THE PRIOR ART

A conventional form of mechanism for feeding items of mail to a franking machine includes a feed drum mounted to rotate about a fixed axis and provided with a raised arcuate surface round a portion of its periphery which, in each revolution of the drum engages the bottom mail item in a stack and delivers it by way of a further feeding device to the franking machine. In order to accommodate items of different lengths the speed of rotation of the drum is varied. The surface speed of the feed drum, therefore, is varied for different lengths of the mail items.

OUTLINE OF THE INVENTION

A main object of the present invention is to make use of a feed drum that always rotates at a constant surface speed and yet can be satisfactorily adapted to different stacks respectively containing items of different lengths. This provides a series of advantages as will be explained at the end of this specification.

According to the present invention, mechanism for feeding similar flat items in succession, with a gap between each item and the next along a substantially horizontal guide, from the underside of a stack of such items, comprises a feed roller which, when the mechanism is in operation, is rotated about its axis at a constant surface speed, a further feeding device spaced along the guide, reciprocating means for raising and lowering the feed roller axis at a frequency such that the roller surface engages the underside of the stack periodically at a rate to feed the items forward along the guide so that they are taken by the further feeding device with gaps of the required length between the items and means for changing the said frequency to adapt the mechanism to different stacks respectively containing items of different lengths in the direction of feeding along the guide so as to eliminate under variations in the length of the gaps between the items when the mechanism is changed over from operation with items of one length to operation with items of another length.

Very advantageously the mechanism is provided with means for locating each stack comprising a forward member for holding the front of each stack in a fixed position common to all stacks and an adjustable rear member for engaging the back of each stack, therefore being positioned in accordance with the length of the items in the stack, and a mechanical connection between the rear member and the frequency changing means for determining the said frequency in relation to the position of the rear member.

In practice, it has been found that a mechanical two speed gear is sufficient to cater for the changes in the lengths of the postal envelopes used in the mechanism. Although such an arrangement is not theoretically as efficient as an infinitely variable speed gear, the mechanical two speed gear is generally less complex and less expensive.

DESCRIPTION OF THE DRAWINGS

In order that the invention may be clearly understood and readily carried into effect, one mechanism in accordance therewith will now be described, by way of example, with reference to the accompanying drawings, in which.

DESCRIPTION OF THE PREFERRED EMBODIMENT

Figure 1:
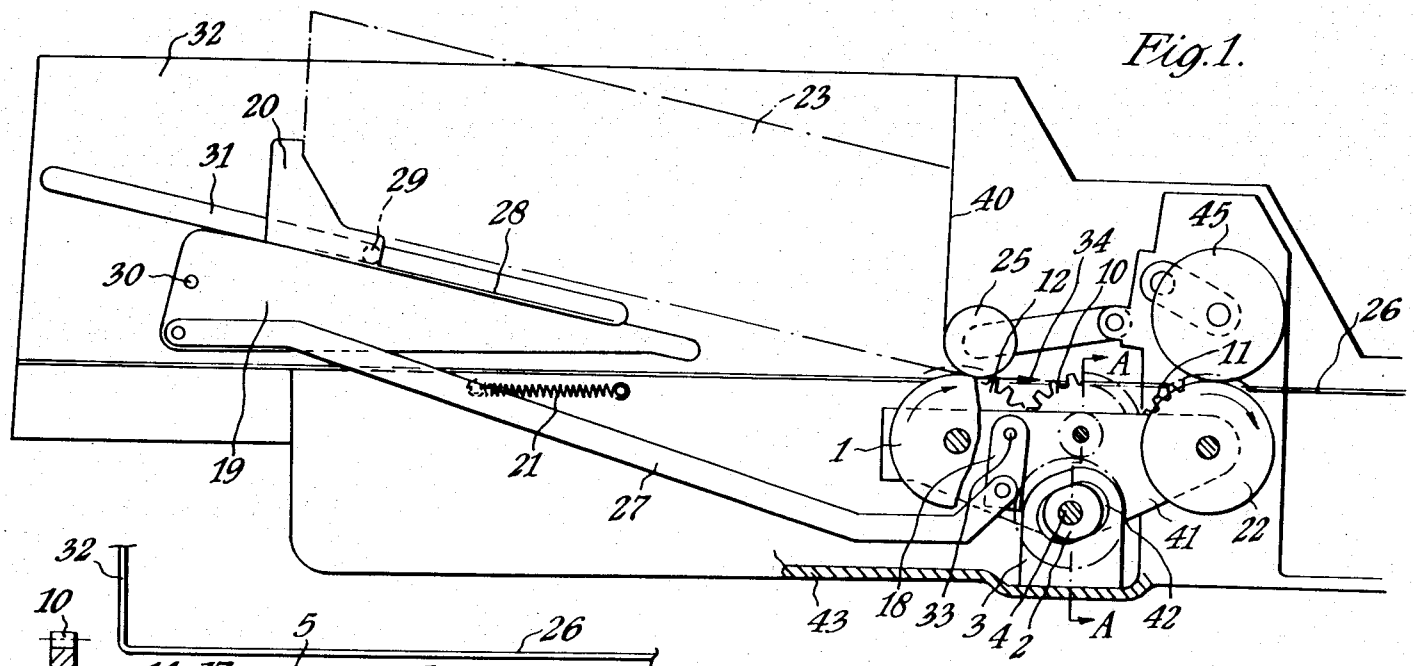
FIG. 1 is a sectional side elevation of an automatic mail feeder mechanism for use with a franking machine.
Figure 2:
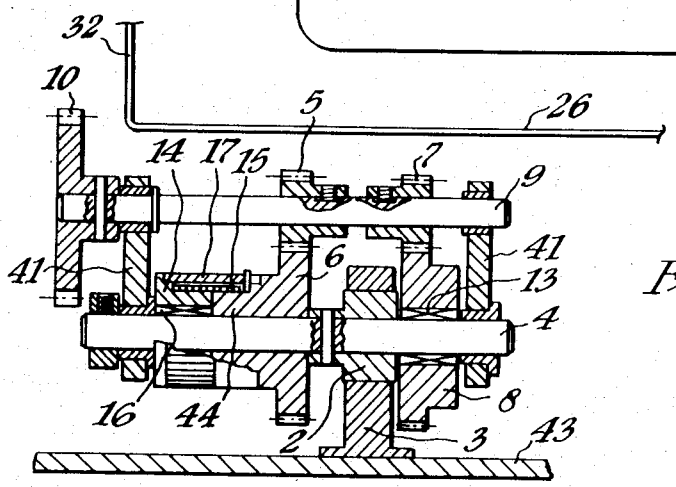
FIG. 2 is a section on the line A—A in FIG. 1.

Referring to FIG. 1, a stack 23 of mail items is mounted between a rear mail guide 20 and a front plate 40. The guide 20 has an integral projection 29 which is positioned along an inclined slot 31 according to the length of the envelopes in the pack. In FIG. 1, the guide 20 is shown in a forward position.

The items are fed in sequence from the bottom of the stack 23 by a reciprocating feed roller 1, the items passing beneath the front plate 40 and along a feed platform 26 to be carried onwards by a pair of rollers 22 and 45 and delivered to a franking machine connected to drive the input rollers. The feed roller 1 is made of a durable rubber-like material with good friction qualities. The input roller 45 is carried by spring loaded pivoted arms.

The reciprocating feed roller 1 rotates continuously at a constant surface speed matched to the surface speed of the associated franking machine and is mounted on a cradle 41 which is rocked about the axis of the input roller 22 by the action of a constantly rotating cam 2. Thus, each time the feed roller 1 is raised, it makes contact with the underside of the stack 23 and drives forward the item of mail at the bottom of the stack. A non-rotating friction device 25 mounted above the platform 26 separates the item of mail to ensure only one item 34 is fed each time the roller is raised. The friction device 25 may be manually adjusted in the vertical direction to separate different thicknesses of mail items, or it may be spring loaded so as automatically to adjust itself to separate these thicknesses.

The surface speed of the input roller 22 is the same as that of the feed roller 1 which is driven by way of an input roller gear 11, an intermediate gear wheel 10 and a feed roller gear 12. The gear wheel 10 is fixed to an intermediate shaft 9, journalled in the cradle 41.

The cam 2 is fixed to a cam shaft 4 journalled in the cradle 41 parallel to the intermediate shaft 9. The cam 2 is an eccentric rotatable in an opening 42 in a cam block 3 fixed to the base 43 of the mechanism. The intermediate gear wheel drives the cam 2 by way of a two speed gear mechanism in which the gear ratio is selected according to the setting of the rear mail guide 20 as will be described below.

In the gear mechanism when the high speed ratio, that is the ratio used when the mail items are shorter than a predetermined upper limit, is engaged, a pinion 5 fixed to the intermediate shaft 9 drives a gear wheel 6 which drives the cam shaft 4 through a clutch assembly. This assembly comprises a sleeve 17 fixed coaxially to the gear wheel 6 for the high speed ratio and surrounding and engaging a wrap spring clutch 15 which in turn surrounds a projection 44 on the gear wheel 6 and a separate coaxial hub 14 which can drive the cam shaft 4 by means of a one way clutch 16. For the high speed drive the wrap spring clutch 15 grips the projection 44 and hub 14 so that the cam shaft 4 is driven by the pinion 5 and gear wheel 6. For the low speed drive, a pinion 7, fixed to the intermediate shaft 9 drives a gear wheel 8 but, when the high speed drive is in operation, the cam shaft 4 rotates faster than the gear wheel 8 in the same direction, this being allowed by a one way clutch 13 between the cam shaft 4 and gear wheel 8.

When the cam 2 is connected for high speed operation as described above, the projection 29 on the rear mail guide 20 bears on an edge 28 of a speed change lever 19 pivoted at 30. This holds a link 27, pivoted to the lever 19, in the position shown in FIG. 1 against the action of a spring 21. When, however, the rear mail guide 20 is pulled back to accommodate a stack of mail items longer than the predetermined limit, the projection 29 parts from the speed change lever 19 allowing the spring 21 to pull the link 27 forward to bring a pawl 18, pivoted at 33 to the cradle 41, into engagement with an external straight knurl surface 24 on the sleeve 17. Then rotation of the sleeve 17 is arrested with the result that the wrap spring clutch 15 is disengaged so that no further drive can be transmitted to the cam shaft 4 from the pinion 5 and gear wheel 6. The low speed drive 7, 8 then takes over rotating the cam shaft 4 through the one way clutch 13 while the one way clutch 16 allows the cam shaft 4 to rotate relatively to the hub 14.

A rear plate 32 projects upwards from one longitudinal edge of the feed platform 26 and the speed change lever 19 together with the upper part of the connecting link 27 are located on the opposite side of the plate 32 from the platform 26 so that the space between the underside of the rear mail guide 20 and the platform 26 is clear to facilitate manual feeding of larger items of mail as and when required when there is no stack in situ without disturbing the rear mail guide and associated feed rate settings.

Advantages of the mechanism particularly described above are as follows:

A. The rate of feed of the items is independent of the surface speed of the feed roller, the feed rate being determined by the selection of one of the two available gear ratios.

B. Where the rotation of the input roller 22 is due to an output drive from a postal franking machine, greater flexibility is achieved in the choice of feed rate without having to compensate for differences in surface speeds with respect to the postal franking machine to which the automatic feeder is coupled.

C. The overall height of the mechanism is lower than that of conventional mechanisms, making it more suitable for compact franking machines.

D. The high speed feed rate allows the most commonly used envelopes to be fed at a comparatively high rate, significantly improving the efficiency of the mail throughput.

E. The feed speed change is automatically controlled according to the length of the envelopes in the stack.

F. The feed speed change can be effected while the mechanism is an operation.

G. Larger items of mail can be manually fed into the mechanism without disturbing the feed rate settings.

We claim:

1. Mechanism for feeding similar flat items in succession to a subsequent utilization device, with a gap between each item and the next along a substantially horizontal guide, from the underside of a stack of such items, the mechanism comprising:

means for supporting a stack of similar flat items;

a substantially horizontal guide extending from one end of said stack supporting means and located to receive the lowermost item in a stack from said supporting means as the item is withdrawn from said stack;

withdrawing means including a feed roller mounted for rotating about its axis and for engaging beneath the lowermost item in a stack supported by said supporting means at the end of the stack adjacent said guide and feeding that item onto said guide;

a rotary feeding device mounted to rotate about an axis parallel to said feed roller axis spaced along said guide and positioned to receive a said item from said feed roller and feed it forward thereby making way for a further such item delivered by said feed roller;

means for continuously rotating said feed roller and said feeding device during the operation of the mechanism;

said withdrawing means including a reciprocable member carrying said feed roller and mounted for alternately moving said feed roller into contact with the bottom item in a stack and withdrawing said feed roller therefrom;

reciprocating means for actuating said reciprocable member at a frequency for engaging said feed roller with the underside of a stack at a rate for feeding items therefrom along said guide to said feeding device with predetermined gaps between the items; and means responsive to the length of the items in a stack in the direction of said guide for changing said frequency and thereby eliminating undue variation in the lengths of the gaps between items fed along said guide when a stack of items of one length is replaced by a stack of items of another length.

2. Mechanism according to claim 1, in which said stack supporting means comprises a forward member for holding the front of each stack in a fixed position relatively to said guide while arranged to permit the lowermost item in the stack to be fed beyond said forward member and an adjustable rear member for engaging the back of a stack, therefore being positioned in accordance with the length of the items in that stack, said frequency changing means including a change speed gear mechanism interposed between on the one hand said means for continuously rotating said feed roller and said feeding device and on the other hand said reciprocating means and further including a mechanical connection between said rear member and said change speed gear mechanism for adjusting said frequency according to the position of said rear member in relation to said forward member.

3. Mechanism according to claim 1, in which said reciprocable member is a cradle mounted to rock about the axis of said rotary feeding device and in which said means for continuously rotating said rotary feeding device and said feed roller include gearing on said cradle interposed between said rotary feeding device and said feed roller, and in which said reciprocating means comprise a rotary cam mounted on said cradle and arranged to rock said cradle about said axis of said rotary feeding device, and in which said frequency changing means comprise a change speed gear mechanism interposed between said gearing and said rotary cam, whereby the rate of rotation of said cam can be altered while the rate of rotation of said feed roller and said feeding device remain constant.

4. Mechanism according to claim 2, in which said change speed gear mechanism is a two speed gear mechanism.

5. Mechanism according to claim 1, in which said reciprocable member is a cradle mounted to rock about the axis of said rotary feeding device and said means for continuously rotating said rotary feeding device and said feed roller include a first gear coaxially fixed to said rotary feeding device, a second gear coaxially fixed to said feed roller and an intermediate gear rotatably mounted on said cradle and interposed between said first and second gears, and said reciprocating means including a cam shaft mounted on said cradle, a rotary cam fixed to said cam shaft, and means providing a fixed cam track for said cam whereby rotation of said cam will cause said cradle to rock about said axis of said rotary feeding device, and said frequency changing means including a third gear freely rotatable on said cam shaft, a fourth gear rotatable on said cam shaft, a first one way clutch interposed between said fourth gear and said cam shaft, two pinions rotatable with said intermediate gear and respectively in mesh with said third and fourth gears, providing two different gear ratios applicable between said intermediate gear and said cam shaft, a hub coaxial with said cam shaft, a second one way clutch interposed between said hub and said cam shaft, a mechanically controlled clutch for providing and releasing a driving connection between said hub and said third gear, and means responsive to the length of items in a stack thereof on said supporting means for actuating said mechanically controlled clutch.

6. Mechanism according to claim 5, in which said third gear is formed with an axial projection registering with said hub and said mechanically controlled clutch is a wrap spring clutch for connecting and disconnecting said hub and said projection, said hub and said projection being arranged to be connected for providing the faster of said two different gear ratios.

7. Mechanism according to claim 2, in which said change speed gear mechanism is a two speed gear mechanism comprising two gear trains providing two different gear ratios and two one way clutches respectively allocated to said two gear trains for enabling each gear train to acutate said reciprocating means when the other gear train is inoperative and a wrap spring clutch for connecting and disconnecting the faster of said two gear trains and its respective one way clutch, thereby enabling the faster gear ratio to be effective or alternatively enabling the slower gear ratio to be effective, said wrap spring clutch comprising a sleeve having an external knurled surface, and said mechanical connection including a lever arranged to be positioned according to the position of said rear member, a pawl and a link connecting said lever and said pawl, said pawl being mounted to engage said knurled surface on said sleeve thereby disengaging said wrap spring clutch when said rear member engages a stack of items longer than a predetermined length.

8. Mechanism according to claim 2, in which said means for supporting a stack is positioned in an inclined position sloping downwards to said feed roller thereby providing a space beneath said supporting means and said rear member, enabling, in the absence of a stack on said supporting means, items longer than items to be stacked on said supporting means to be fed manually to said feed roller, said mechanical connection being mounted on one side of said supporting means.

9. Mechanism according to claim 1, wherein said subsequent utilization device comprises postal franking machine and said items are items of mail fed by said mechanism from stacks of mail to the franking machine, the speed of said feed roller and of said rotary feeding device being matched to the speed of operation of the franking machine.

10. Mechanism for feeding similar flat items in succession with a gap between each item and the next along a substantially horizontal guide from the underside of a stack of such items, the mechanism comprising:

means for supporting a stack of similar flat items including a forward member for holding the front of the stack against movement in a feed direction while arranged to permit the lowermost item in the stack to be fed forward in said feed direction and an adjustable rear member for engaging the back of a stack, therefore being positioned in accordance with the length of the items in that stack, said stack supporting means being arranged to provide an exposed area of a stack on the underside thereof;

a cradle mounted to rock about a fixed axis;

a feed roller mounted on said cradle for rotation about an axis parallel to said fixed axis, said cradle being mounted to rock towards and away from a position in which said roller engages said exposed area of a stack for feeding the lowermost item in the stack in said feed direction;

a substantially horizontal guide extending in said feed direction from said stack supporting means to receive each item fed forward by said feed roller;

a feeding device mounted to rotate about said fixed axis and positioned to receive said item from said feed roller and feed it forward thereby making way for a further such item delivered by said feed roller;

gearing mounted on said cradle for continuously rotating said feed roller and said feeding device during the operation of said mechanism;

a rotary cam mounted on said cradle;

a stationary cam track member to be engaged by said cam for rocking said cradle;

two speed gear mechanism interconnecting said gearing and said cam;

a wrap spring clutch operative to select the output speed of said gear mechanism and accordingly the speed of said cam in relation to said feed roller; and actuating mechanism responsive to the position of said adjustable rear member for controlling said wrap spring clutch for selecting its output speed.

* * * * *